United States Patent [19]

Gardner et al.

[11] Patent Number: 4,466,266

[45] Date of Patent: Aug. 21, 1984

[54] FORGING APPARATUS

[75] Inventors: Robert M. Gardner; Ronald L. Thompson, both of Worcestershire, England

[73] Assignee: GKN Forgings Limited, Bromsgrove, England

[21] Appl. No.: 432,444

[22] Filed: Oct. 4, 1982

[30] Foreign Application Priority Data

Oct. 8, 1981 [GB] United Kingdom ..... 8130432

[51] Int. Cl.[3] ..... B21D 22/00

[52] U.S. Cl. ..... 72/357; 72/358; 72/453.08

[58] Field of Search ..... 72/357, 358, 359, 453.01, 72/453.08; 29/159 R

[56] References Cited

U.S. PATENT DOCUMENTS 3,839,896 10/1974 Hamada ..... 72/453.01

4,051,708 10/1977 Beane et al. ..... 29/159 R

*Primary Examiner*—Leon Gilden

*Attorney, Agent, or Firm*—Marshall, O'Toole, Gerstein, Murray & Bicknell

[57] ABSTRACT

A forging press for producing flashless forgings from metal billets or pre-forms has a die-head (26) slidably mounted in a press-head (10) whereby it may retract into the press-head if a predetermined pressure on the die-head is reached or exceeded during the forging stroke. The die-head (26) is slidably mounted in a bore (30) containing hydraulic fluid and connected via conduits (38) and pressure relief valves (40) to a hydraulic reservoir (32). A die cavity for the billet or pre-form is defined between relatively movable die halves (16) and (18).

13 Claims, 4 Drawing Figures

FORGING APPARATUS

BACKGROUND TO THE INVENTION

This invention relates to a forging press of the type incorporating a closeable die assembly for the production of "flashless" forgings.

Forging presses incorporating closeable die assemblies are well known for the production on non-ferrous metal components, such as brass forgings, but are not generally utilised for the production of ferrous components. This has been due in part to the high temperature, typically in the range 1100°–1200° C., encountered in forging steel components and the difficulties encountered in overheating of dies and in avoiding distortion of the die set during forging at this temperature. Also, it is known that greatly increased pressures within the die set are encountered if the metal billet is below the ideal forging temperature or has a greater volume than that of the required component.

However, some development work has been carried out in the area of flashless forging of ferrous components and this work is described in Proceedings of the Institute of Mechanical Engineers, 1980 volume 194 number 15 in an article by T. A. Dean entitled "Design Testing and Production Performance of a Die Set for Flashless Forging". This article describes the construction of a totally enclosed one-piece die set mounted on a pressure regulated hydraulic lower bolster of a press, for accommodating overload pressures such as may occur with the use of an oversized billet or a billet that is below the ideal forging temperature.

It is an object of the present invention to provide a construction of forging press for producing flashless components which has the flexibility of use with which to produce a finished component from a ferrous or non-ferrous metal billet or pre-form which may be of greater volume than that of the required finished component and which may be press-forged within a wide temperature range varying from the relatively high temperature requirements of ferrous forging down through the 'warm forging' range to cold forging.

SUMMARY OF THE INVENTION

According to the present invention there is provided a forging press for the production of flashless forgings from metal billets or pre-forms wherein the press comprises a die assembly defining a die cavity, a press head reciprocable towards and away from the die assembly and a die-head carried on the press-head to be co-operable, during a forging stroke, with the die assembly to forge a metal billet or pre-form located in the die cavity to a shape corresponding to the shape bounded by the die cavity and the die-head characterised by the combination that:

(a) the die assembly is openable and closable, (b) releasable locking means are provided to lock the die assembly in its closed condition during the forging stroke of the press, and (c) the die-head is movable axially towards the press-head if a pre-determined pressure on the die-head is reached or exceeded during the forging stroke.

Conveniently a bore is provided within the press-head within which the die-head is axially slidable, the bore and the die-head defining together a fluid pressure piston and cylinder assembly responsive to pressure on the die-head during the forging stroke whereby, if a said pre-determined pressure is reached or exceeded, fluid is displacable from the bore permitting sliding movement of the die-head therein towards the press-head. At least one pressure relief valve may be associated with the bore in the press-head to permit passage of fluid through said valve from the bore when a said pre-determined pressure is reached or exceeded and a plurality of conduits are conveniently provided to extend out of the bore with a said pressure relief valve associated with each conduit.

The said releasable locking means may be operable to lock the die assembly in its closed condition independantly of the movement of the press-head and may comprise a wedge element engagable with a co-operating part of the die assembly to lock the die assembly in its closed condition. Preferably the wedge element is reciprocable towards and away from the said co-operating part of the die assembly by means of a double acting fluid pressure actuated piston and cylinder assembly.

Alternatively said releasable locking means may be actuated by the press-head to lock the die assembly in its closed condition during movement of the press-head towards the die assembly on the forging stroke. In this arrangement the releasable locking means may again comprise a wedge element engagable with a co-operating part of the die assembly to lock the die assembly in its closed condition and said wedge element may comprise an annular locking ring carried by the press-head and having a wedge surface engagable with co-operating annular wedge surface of the die-assembly.

In both of the arrangements described above quick release means are conveniently provided, actuable by movement of the press-head away from the die assembly after completion of the forging stroke, for effecting initial unlocking of the releasable locking means from the die assembly.

BRIEF DESCRIPTION OF THE DRAWINGS

Other features of the invention will become apparent from the following description given herein solely by way of example with reference to the accompanying drawings wherein.

DESCRIPTION OF PREFERRED EMBODIMENTS

Figure 1:
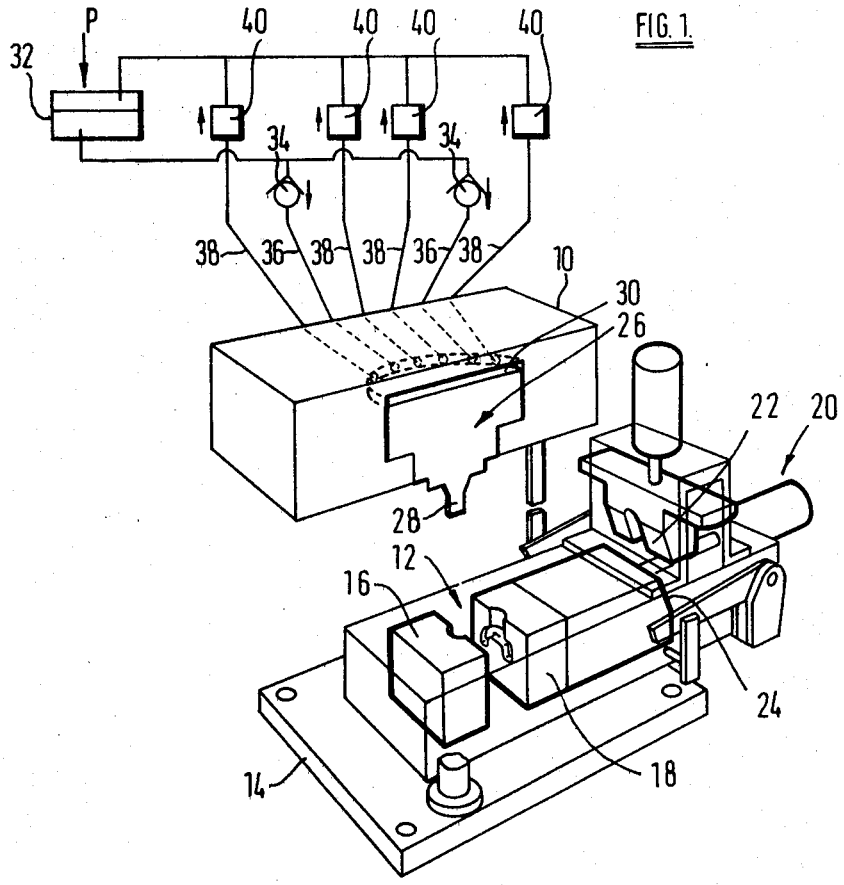
FIG. 1 is a schematic view of part of a forging press according to the invention.

The schematic view of FIG. 1 illustrates part of a forging press suitable for the hot forging of ferrous billets or pre-forms. However the forging press in accordance with the invention may be utilized for forging of other metals and may also be utilized for forging at temperatures lower than those usually associated with ferrous forging; thus the press can be utilized for 'warm forging' or even cold forging.

In this example the forging press is a mechanical crank press wherein the forging stroke is accomplished during downward movement of an upper press-head 10 to its bottom dead centre position relative to a lower fixed die assembly 12 carried on a fixed bed or bolster 14.

A mechanical crank press of this nature cannot normally be utilized for the production of flashless forgings because, if an over-sized or under-temperature billet was present in the die assembly the press-head would be unable to complete its forging stroke through bottom dead centre and would lead, at best to stalling of the press and, at worst, to breakage of the press mechanism.

As shown in FIG. 1, those parts of the press which are illustrated comprise the fixed lower bed or bolster 14 and the press-head 10 reciprocable towards and away from the bolster 14. The die assembly 12 is carried on the bolster 14 and comprises a fixed die element 16 and a movable die element 18, operable via an actuating mechanism 20, to engage the fixed die 16 to define a die cavity therebetween. The die cavity may be of complex shape but the fact that the die cavity is defined by a plurality of separate die elements 16 and 18 will enable the die assembly to be opened for removal of the finished forging. In FIG. 1 a releasable locking means comprises a wedge element 22 engagable with a co-operating wedge surface 24 on the movable die element 18 to lock the die assembly together during the forging stroke.

The press-head 10 carries a die-head 26 having a portion 28 co-operable, during the forging stroke, with the die assembly 12 to forge the billet or pre-form located in the die cavity to a shape corresponding to the shape bounded by the die cavity and a die-head portion 28. The die-head 26 is slidably received within a bore 30 in the press-head 10 to define together a fluid pressure piston and cylinder assembly wherein a hydraulic fluid is contained within the bore 30 above the die-head 26. Hydraulic fluid pressure is maintained within the bore 30 by means of pneumatic pressure applied in the direction of the arrow P to a fluid reservoir 32 which communicates via one-way valves 34 and conduits 36 to the bore. A further set of conduits 38 extend from the bore 30 via a pressure relief valve 40 in each conduit 38 to the fluid reservoir 32. A pre-determined pressure is set on each pressure relief valve 40 whereby if, during the forging stroke, the pressure exerted on the die-head 28 reaches or exceeds such pre-determined pressure, the die-head 28 can move axially into the press-head 10 and may then be extended outwardly of the press-head 10 during the upstroke thereof via the one-way valves 34. For convenience, two such one-way valves 34 and four such pressure relief valves 40 are shown in FIG. 1 although it will be appreciated that any convenient number may be provided; the number of pressure relief valves 40 usually being determined by the response time required for the die-head to move towards the press-head when the pre-determined pressure is reached within the bore.

Figure 2:
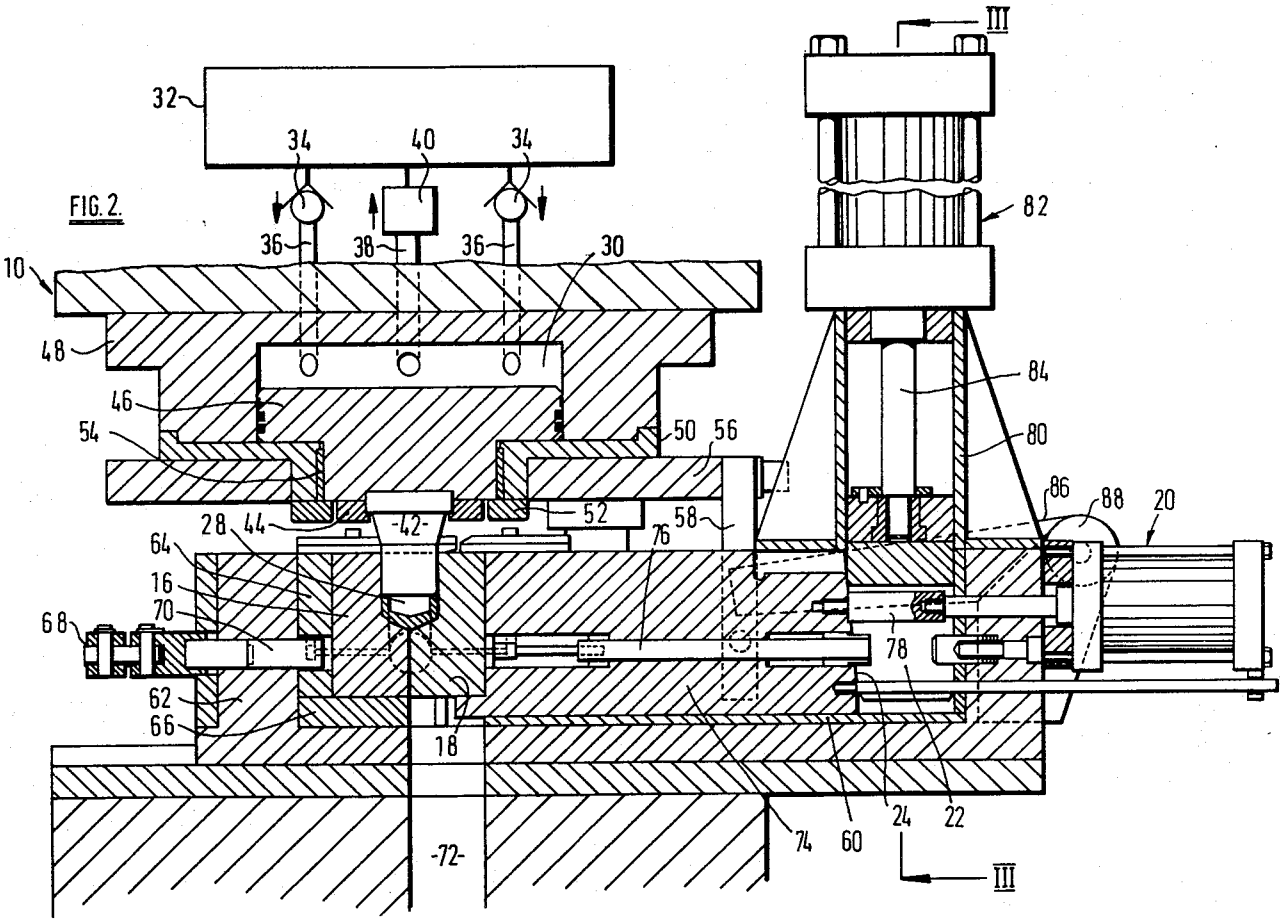
FIG. 2 is a sectional view of the press of FIG. 1.
Figure 3:
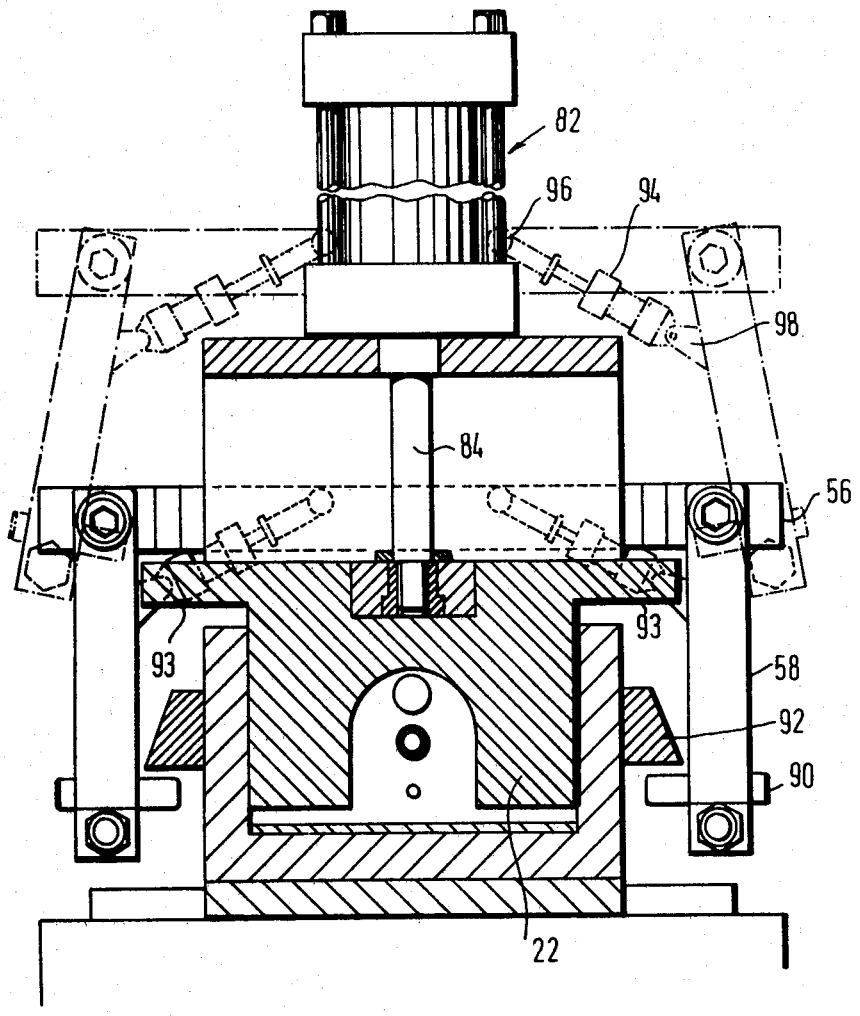
FIG. 3 is a section of the locking means of the press along the line III—III of FIG. 2.

Referring now to FIGS. 2 and 3 of the drawings, which are more detailed views of the schematic illustration of FIG. 1, the die-head 26 is shown in its fully engaged position with the die-assembly 12 i.e. at the completion of the forging stroke.

The die-head comprises the die-head portion 28 depending from an arbor 42 fixed by a retaining ring 44 to a piston portion 46 of the die-head 26 slidable within the bore 30 of the cylinder portion 48 of the press-head 10. The bore 30 is connected as already described with reference to FIG. 1, by conduits 38 to pressure relief valves 40 and by conduits 36 to one-way valves 34.

The piston portion 46 is retained within the cylinder portion 48 by a flange 50 and collar 52. A bearing bush 54 is provided between the piston portion 46 and flange 50 to facilitate axial movement of the piston portion 46 within the cylinder portion 48. A plate 56 is fixed to the flange 50 for movement with the press head 10 and incorporates an arm 58 engagable with quick release means for the releasable locking means, to be described in more detail below.

The die assembly 12 comprises the fixed die element 16 and the movable die element 18 slidable along a guide track 60 on the bolster 14. The fixed die element 16 comprises a die support 62 within which are provided shim plates 64 and 66 between the die element 16 and die support 62 to enable accurate location of the die element 16 relative to the corresponding movable die element 18. An ejector mechanism 68 is provided on the support 62 and incorporates a ram 70 slidable within a bore in the support 62 to eject a forged component from the die cavity when it is opened after completion of the forging stroke. Ejection of the forged component is in the vertically downward direction through a forging dispensing aperture 72.

The movable die element 18 comprises a die support 74 reciprocable along the guide track 23 towards the fixed die element 16. A further ram ejection mechanism 76 is provided on the support 74 to positively eject, if required, the forged component from the die cavity. Reciprocation of the die support 74 along the guide track 60 is by the die actuating mechanism 20 comprising a pneumatic piston and cylinder assembly. Linkage 78 connects the piston of the assembly 20 to the die support 74 to reciprocate the support 74 towards and away from the fixed die element 16.

Wedge locking means 22–24 are provided to lock the movable die element 18 into engagement with the fixed die element 16 during forging of the component and comprise a wedge head 22 slidable within a bracket 80 and vertically reciprocable via a fluid pressure piston and cylinder impact assembly 82, connected thereto by connecting rod 84. Wedge head 22 is engagable with a corresponding wedge surface 24 at one end of the die support 74 such that movement of the head 22 downwards progressively engages the wedge surface 24 to lock the movable die element 18 against the fixed die element 16.

Quick release of the wedge head 22 from its fully locked position is facilitated by release means comprising a pair of release arms 86 each pivotally mounted on a pivot pin 88. Movement of each release arm 86 in an upward direction is initiated by a peg 90 fixed to the arm 58 on the plate 56. Details of the operation of the quick release mechanism can best be seen with reference to FIG. 3 in which the release mechanism is additionally shown in phantom in its position corresponding to release of the the wedge head 22. When the wedge head 22 is fully locked against the wedge surface 24 on the movable die element 18, each of the arms 58 depending from the plate 56 are substantially vertical and the pegs 90 are thus engagable with inclined projections 92 integral with each release arm 86. It will be apparent that, during upward movement of the press head 10 and hence plate 56, positive release of the wedge head 22 from its locked position is achieved by each of the pegs 90 engaging with a corresponding projection 92 on the arms 86 which arms in turn mechanically lift the wedge head 22, by engaging surfaces 93 thereon, away from the corresponding wedge surface 24 on the movable die element 18. When the press head 10 is in its fully raised position, each of the arms 58 is pivoted outwardly (shown in phantom) due to operation of pneumatic rams 94 fixed at one end 96 to the plate 56 and at the other end to a bracket 98 on each arm 86.

In operation, with the forging press starting from the position corresponding to that shown in FIG. 1, the die actuating mechanism 20 moves the die element 18 into engagement with the fixed die element 16 to define a cavity within which a metal billet or pre-form is introduced. The movable die element 18 is then locked against the fixed die element 16 by fluid pressure actuated impact by assembly 82 of the wedge head 22 into engagement with the corresponding wedge surface 24 on the movable die element 18. The press head 10 then moves downwardly towards the bolster 14 such that the die-head portion 28 on the die-head 26 progressively engages the metal billet to form a forged component. At this stage the press is in a position corresponding to that shown in FIG. 2.

When the component has been satisfactorily forged, the press head 10 is moved upwardly and each of the pegs 90 engages with a complementary release arm 86 which then quickly releases the wedge head 22 out of its locked engagement with the wedge surface 24 subsequent to which the wedge head 22 can be fully retracted from its locked position by the assembly 82. During return of the press head 10 to its fully raised position, the die actuating mechanism 20 is operated to slide the movable die element 18 away from the fixed die element 16 to fully release the forged component which may then exit through the forging dispensing aperture 72. Positive release of the forged component from the die elements, if required, is possible via ejectors 70 or 76.

However, if during the forging stroke excess pressure is exerted on the die-head 26, which pressure may be due to an oversized billet or a billet that is below the ideal forging temperature, axially upward movement of the die-head 26 relative to the press head 10 is possible due to the fluid linkage via the pressure relief valves 40. Thus, in the case of an oversized billet at the correct forging temperature, the billet is forged to the shape determined by the cavity formed between the die elements 16 and 18 and the die-head portion 28 but, due to axial retraction of the die-head 26, the forged component will have a dimension at one end, in the axial plane, greater than that required of the finished component. It would therefore be necessary to machine the excess material from this part of the forged component at a later stage.

Consequently, highly accurate dimensional preparation of the billet prior to forging is not necessary, even though the forging press does not provide for excess billet material to exit from the die cavity in the form of flash. This has the advantage in that all of the billets to be fed into the press may be roughly cut to size within a tolerance range which does not require elaborate and expensive forming of the billet prior to the forging process. A forging press according to the present invention therefore dispenses with the requirement for accurate machining of each individual billet before it is forged and only requires such machining of those billets which are found to have excess material after forging.

The quick release means shown with reference to FIGS. 1 to 3 has the advantage that positive release of the locking wedge 22 during the initial upstroke of the press head 10 is obtained thus ensuring the minimum of dwell time of the forged component within the die cavity. This is important if die temperatures are not to become excessive thereby leading to premature die failure and if distortion of the die faces through heat transfer from the forged component is to be avoided.

Figure 4:
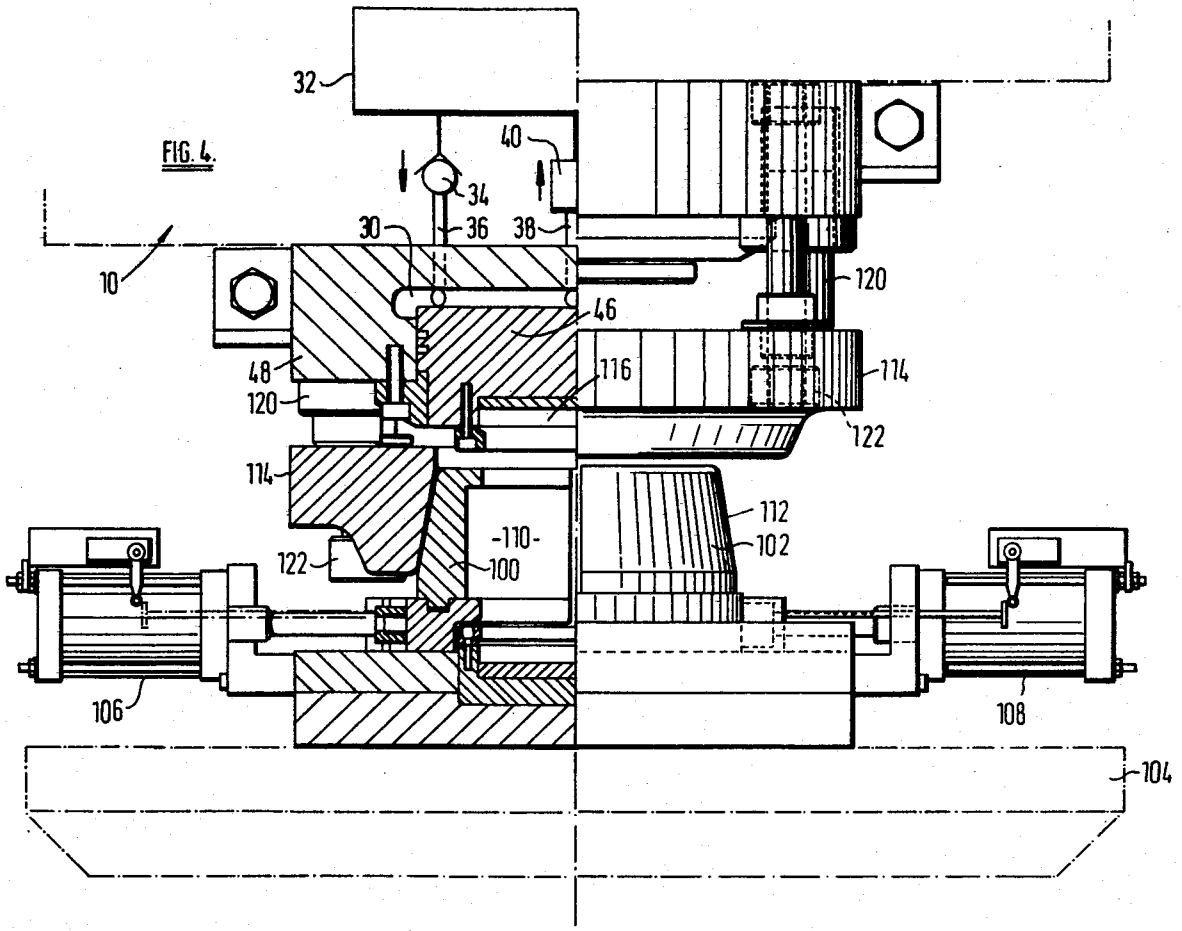
FIG. 4 is a part-sectional view of an alternative locking means.

An alternative die assembly and locking arrangement is shown in FIG. 4 in which both of the die halves 100 and 102 are movable along guide tracks on the bolster 104. Each of the die halves 100 and 102 have independent respective actuating mechanisms 106 and 108 such that the die parts 100 and 102 are each horizontally reciprocable. The engaged die parts 100 and 102 define a die cavity 110 of shape corresponding substantially to that required of the finished forged component. The parts 100 and 102 further define on their outer periphery a frusto-conical annulus 112 having a wedge surface engagable by a complementary wedging annular ring 114, vertically slidable relative to and carried by a cylinder portion 48 of the press head 10. A die-head comprises a die 116 fixed to a piston portion 46 slidable within a bore 30 of the cylinder portion 48.

Operation of the press of FIG. 4 is substantially identical to that herein described with reference to FIGS. 1 to 3. In FIG. 4, the sectional details on the left-hand side of the drawing correspond substantially to the fully engaged position wherein the press head 10 has been lowered towards the bolster 104 and the die 116 on the die-head is engaged with the die parts 100 and 102 to fully enclose the die cavity 110. In this position, the annular locking ring 114 has been moved downwardly by virtue of its being carried directly on the press head 10 into engagement with the frusto-conical annulus 112 defined by the outer surfaces of the engaged die parts 100 and 102 to lock these die parts in a closed position during forging of a billet. The locking ring 114 is held down in its locked position by fluid pressure assemblies 120.

In the position corresponding to that shown to the right of the drawing, the locking ring 114 has been withdrawn from the annulus 112 by quick release studs 122 and the press head 10 has been moved upwardly to a position corresponding to that shown in FIG. 1. Each of the die parts 100 and 102 are then pulled apart by the actuating mechanisms 106 and 108 and the forged component withdrawn.

The provision of a frusto-conical annulus 112, defined when the die parts 100 and 102 are engaged, provides a wedge locking surface in principal similar to the corresponding wedge surface 24 shown with reference to FIGS. 1 and 2.

In the embodiments shown with reference to FIGS. 1 to 3 and the embodiment shown with reference to FIG. 4, it is envisaged that multiple die parts may be provided such that complex shapes may be forged that are not otherwise possible when using a two-part die assembly.

We claim:

1. An improved mechanical crank press for the production of flashless forgings from metal billets or preforms wherein the press comprises a die assembly defining a die cavity, a press-head reciprocable towards and away from the die assembly and a die-head carried on the press-head to be co-operable, during a forging stroke, with the die assembly to forge a metal billet or pre-form located in the die cavity to a shape corresponding to the shape bounded by the die cavity and the die-head; the die assembly being openable and closable; releasable locking means to lock the die assembly in its closed condition during the forging stroke of the press; the die-head being movable axially towards the press-head; and fluid pressure means for maintaining the die-head in a fully extended position outward from the press-head at a predetermined maximum fluid pressure during the forging stroke but when the pressure on the die-head during a forging stroke exceeds said maximum pressure said die-head reciprocates axially relative to and toward the press-head to protect the die-head and prevent press stalling.

2. A forging press as claimed in claim 1 further characterised in that a bore is provided within the press-head within which the die-head is axially slidable, the bore and the die-head defining together a fluid pressure piston and cylinder assembly responsive to pressure on the die-head during the forging stroke whereby, if a said pre-determined pressure is reached or exceeded, fluid is displaceable from the bore permitting sliding movement of the die-head therein towards the press-head.

3. A forging press as claimed in claim 2 further characterised in that at least one pressure relief valve is associated with the bore in the press-head to permit passage of fluid through said valve from the bore when a said predetermined pressure is reached or exceeded.

4. A forging press as claimed in claim 3 further characterised in that a plurality of conduits extend out of the bore and a said pressure relief valve is associated with each conduit.

5. A forging press as claimed in claim 1 wherein the die assembly comprises a plurality of die elements movable towards and away from one another and being lockable together, in their closed together condition, by said releasable locking means.

6. A forging press as claimed in claim 1 wherein said releasable locking means is operable to lock the die assembly in its closed condition independantly of the movement of the press-head.

7. A forging press as claimed in claim 6 wherein said releasable locking means comprises a wedge element engagable with a co-operating part of the die assembly to lock the die assembly in its closed condition.

8. A forging press as claimed in claim 7 wherein the wedge element is reciprocable towards and away from the said co-operating part of the die assembly by means of a double acting fluid pressure actuated piston and cylinder assembly.

9. A forging press as claimed in claim 1 wherein said releasable locking means is actuated by the press-head to lock the die assembly in its closed condition during movement of the press head towards the die assembly on the forging stroke.

10. A forging press as claimed in claim 9 wherein said releasable locking means comprises a wedge element engagable with a co-operating part of the die assembly to lock the die assembly in its closed condition.

11. A forging press as claimed in claim 10 wherein the wedge element comprises an annular locking ring carried by the press-head and having a wedge surface engagable with a co-operating annular wedge surface of the die assembly.

12. A forging press as claimed in claim 1 wherein quick release means are provided, actuable by movement of the press-head away from the die assembly after completion of the forging stroke, for effecting initial unlocking of the releasable locking means from the die assembly.

13. An improved mechanical crank press for the production of flashless forgings from metal billets or preforms wherein the press comprises a die assembly defining a die cavity, a press-head reciprocable towards and away from the die assembly and a die-head carried on the press-head to be co-operable, during a forging stroke, with the die assembly to forge a metal billet or pre-form located in the die cavity to a shape corresponding to the shape bounded by the die cavity and the die-head; the die assembly being openable and closable; releasable locking means to lock the die assembly in its closed condition during the forging stroke of the press; and means mounting the die-head for reciprocal axial movement in and relative to the press-head from a fully extended position outward from the press-head to a position axially closer to the press-head when a predetermined maximum pressure on the die-head is exceeded as the press-head moves toward the die assembly during a forging stroke, so that the press-head can move to its bottom dead centre position, with movement of the die-head momentarily stopped when such predetermined maximum pressure is exceeded, when the billet or pre-form is over-sized or under-temperature, to protect the die-head and prevent press stalling.

* * * * *